US006435607B1

(12) United States Patent
Liu

(10) Patent No.: US 6,435,607 B1
(45) Date of Patent: Aug. 20, 2002

(54) FOLDING MASSAGE CHAIR STRUCTURE

(76) Inventor: Tsan-Chin Liu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/726,128

(22) Filed: Nov. 30, 2000

(51) Int. Cl.[7] ..... A47C 4/00

(52) U.S. Cl. ..... 297/55; 297/16.1; 297/57; 297/23

(58) Field of Search ..... 297/16.1, 35, 55, 297/57, 23, 34, 46, 59

(56) References Cited

U.S. PATENT DOCUMENTS 105,253 A * 7/1870 Rodgers ..... 297/57
146,523 A * 1/1874 Formica et al. ..... 297/57
398,943 A * 3/1889 Crandall ..... 297/45
4,386,790 A * 6/1983 Kassai ..... 280/650
4,576,149 A * 3/1986 Otuka et al. ..... 601/99
5,833,590 A * 11/1998 Chiu et al. ..... 482/142

* cited by examiner

*Primary Examiner*—Peter M. Cuomo
*Assistant Examiner*—Joseph Edell
(74) *Attorney, Agent, or Firm*—Troxell Law Office PLLC

(57) ABSTRACT

A folding massage chair structure, the innovative features of which includes the fixing of guide sleeves at the rear surface of the chair back. The guide sleeves have inserted through them guide rods and the center sections of the guide rods are conjoined to the seat cushion. The lower sections of the guide rods are conjoined to the chair leg. There are support plates installed on the lower guide sleeves, with the upper ends of the support plates conjoined to rear end of the seat frame. When the seat cushion is pulled upward, the pivotably interconnected structure allows the massage chair to be completely folded.

2 Claims, 2 Drawing Sheets

FOLDING MASSAGE CHAIR STRUCTURE

BACKGROUND OF THE INVENTION

1) Field of the Invention

The invention herein relates to a folding massage chair structure for medical treatment and health care applications that can be conveniently folded when not utilized to minimize the square area occupied and, furthermore, reduce production cost, lower the marketed price, and thereby provide economic advantages.

2) Description of the Prior Art

Massage chairs currently available on the market are typically of similar sofa stylings and although users are more comfortable seated on them, since the physical dimensions are quite ample and the weight is heavier, shipping and moving them are inconvenient and, furthermore, their marketed price is expensive and they are not economically worthwhile.

In view of the design shortcomings and inconvenient aspects of conventional massage chairs, the inventor of the invention herein, based on experience and specialized technical knowledge gained from numerous years of engagement in the relevant industries, conducted research and development to innovate a massage chair having greater practicality and, furthermore, that meets the requirements of economical pricing.

TECHNOLOGICAL CONTENT

The innovative features of the folding massage chair structure of the invention herein include: The massage chair back has installed at its two sides an upper and a lower guide sleeve, with the said upper and lower guide sleeves respectively conjoined to two guide rods; the lower ends of the said guide rods utilize a rod to conjoin them to a chair leg and a roller wheel is ensleeved onto the said rod; the center sections of the guide rods are conjoined to connector plates and the front ends of the connector plates are conjoined to a seat frame by a another rod; the said seat frame has disposed on it a seat cushion and armrests and at the rear end of the said seat frame is yet another rod, the said seat frame utilizing the said rod for its conjoinment to support plates and rear support rods; the lower ends of the said rear support rods are conjoined to the chair leg by the same aforesaid rod; and the said support plates have at their lower ends an additional rod that conjoins them onto the lower guide sleeves; when the seat cushion is pulled upward, since the seat frame conjoined to the connector plates by the said rod share the same axis, the front section of the seat frame turns upward and rear end of the seat frame also moves upward, at which time the seat frame braced by the support plates is moved upward and the connector plates on the said seat frame cause the guide rods to slide upward along the guide sleeves. Meanwhile, the downward motion of the seat frame rear end moves the rear support rods downward and folds the chair leg upward. When the seat cushion is folded flat against the chair back, the guide rods are retracted upward along the upper and lower guide sleeves, while the chair leg is also folded down against the rear surface of the chair back such that the entire massage chair is complete folded.

Furthermore, the motive power structure of the invention herein is installed at the lower extent of the chair back rear surface and, furthermore, extends to the lower surface of the seat cushion, with the said structure capable of maintaining in position a massage wheel at the lower surface of the seat cushion while it is not utilized.

The said structure enables the massage chair to be folded up when not utilized such that its physical size is significantly reduced which minimizes the space it would normally occupy and facilitates easier moving and storage practicality and, furthermore, allows for economical pricing.

SUMMARY OF THE INVENTION

The objective of the invention herein is to provide a folding massage chair structure which when not being utilized is foldable to decrease the amount of surface area it would otherwise occupy and, furthermore, has a low production cost, is easy to promote due to its inexpensive price, and is economically advantageous.

To enable the examination committee to further understand the functions, structure and other innovative features of the invention herein, the most preferred embodiment of the invention herein presented is accompanied by the brief description of the drawings below and followed by the detailed description of the invention.

DETAILED DESCRIPTION OF THE INVENTION

Figure 1:
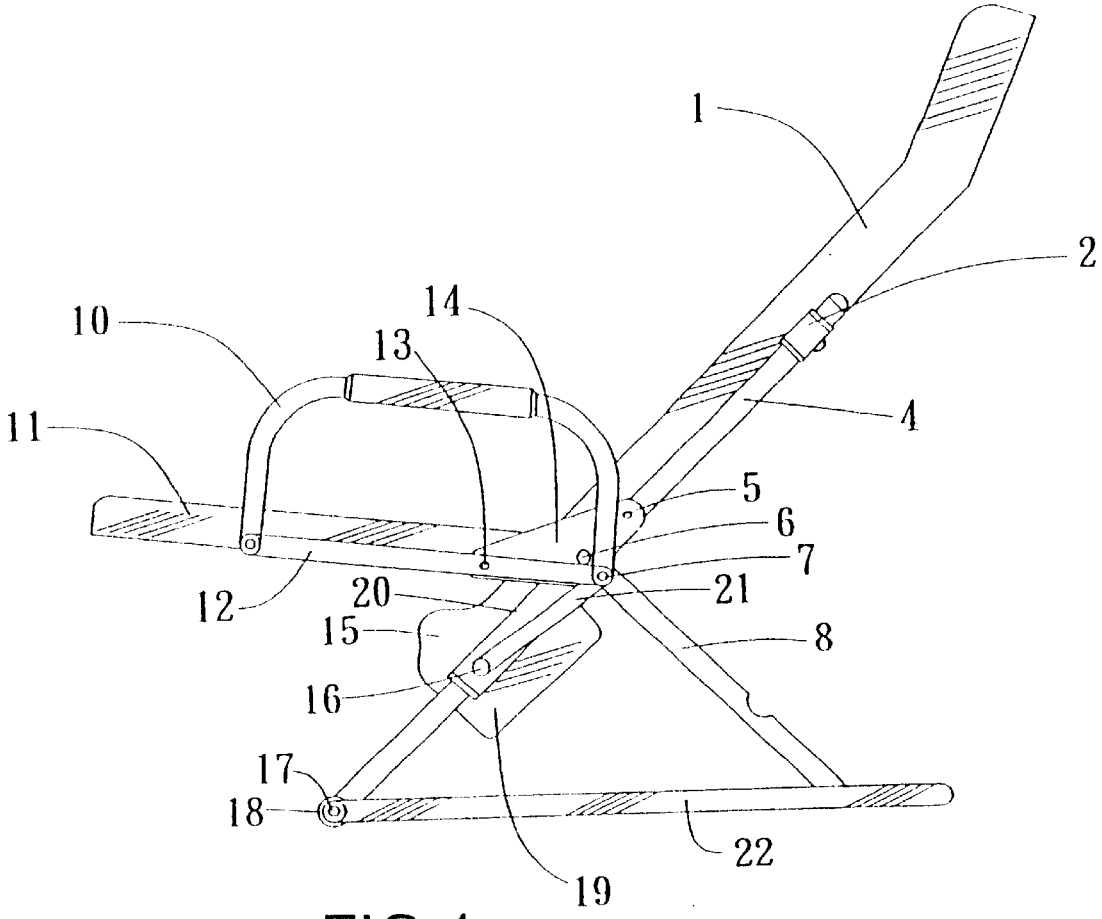
FIG. 1 is an orthographic drawing of the invention herein when opened, as viewed from a lateral perspective.
Figure 2:
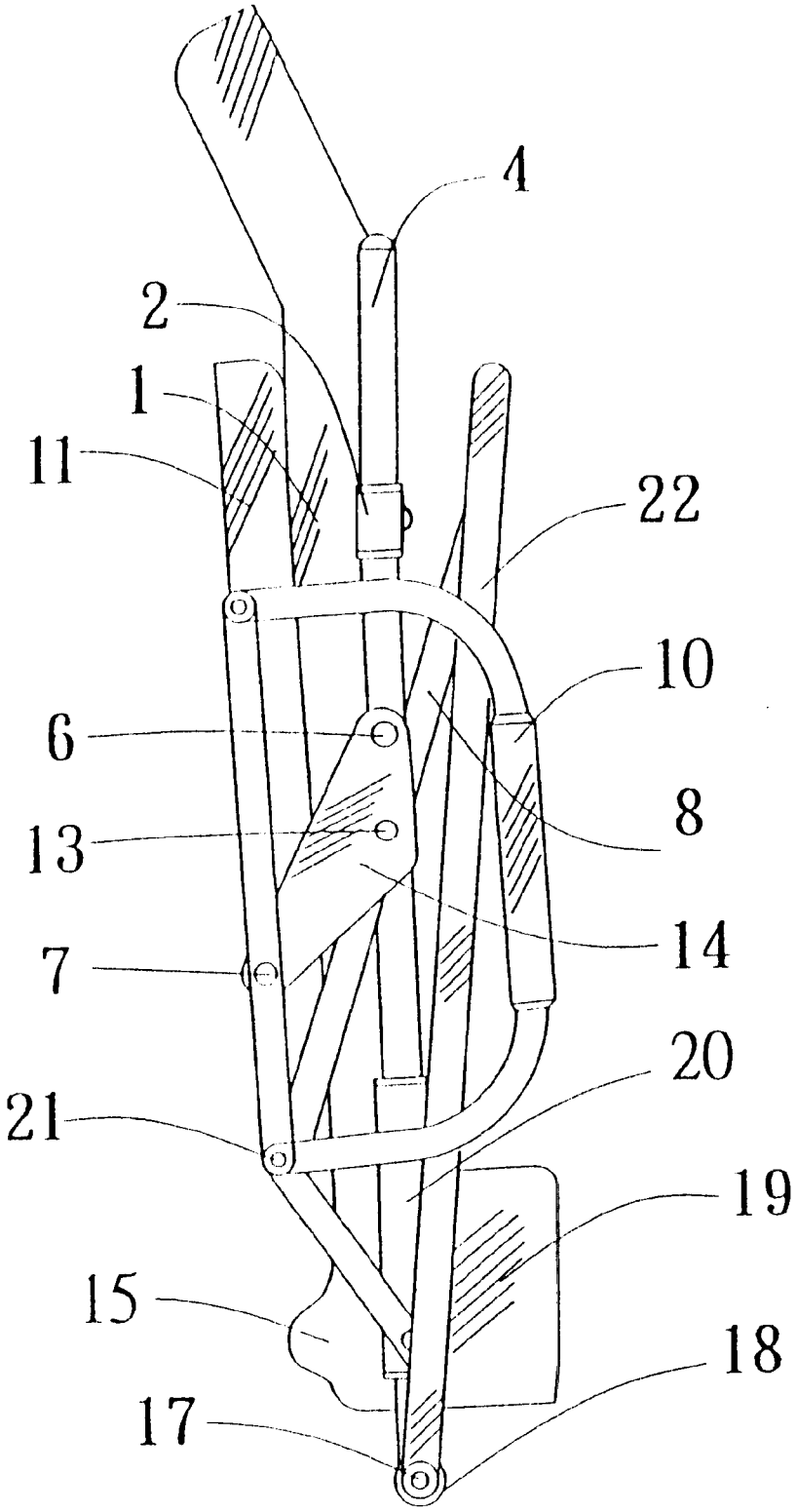
FIG. 2 is an orthographic drawing of the invention herein when folded, as viewed from a lateral perspective.

Referring to FIG. 1 and FIG. 2, the massage chair back 1 has fixed at its two sides an upper guide sleeve 2 and a lower guide sleeve 20; respectively inserted through each set of said upper and lower guide sleeves 2 and 20 is a guide rod 4; inserted through the lower ends of the guide rods 4 and conjoining them to a chair leg 22 is a rod 17, with the said rod 17 at the same time also inserted through a roller wheel 18; said guide rods 4 have installed at their center sections fastening screws 5 and 6 that fix a connector plate 14 onto the said guide rods 4; and having another fixing function, the said fastening screws 6 are situated against the rear end of a seat frame 12 when the chair is in the opened state, but are also capable of maintaining the position of the entire folded structure. Utilized at the front end of the said connector plates 14 is a rod 13 that conjoins them to the seat frame 12 serves as a rotation axis of the seat frame 12. The seat frame 12 has disposed on it a seat cushion 11 and armrests 10, and the said seat frame 12 has installed at its rear end a rod 7, the said seat frame 12 utilizing the rod 7 for its conjoinment to support plates 21 and rear support rods 8, and the said support plates 21 have at their lower ends a rod 16 that conjoins them onto the lower guide sleeves 20. The said structural components are assembled into a foldable structure. When the seat cushion 11 is pulled upwards, the seat frame 12 turns upward on the rod 13 serving as the axis and the rear end of the seat frame 12 moves downward, at which time the seat frame 12 braced by the support plates 21 is forced upward such that the connector plates 14 cause the upper guide sleeves 2 and the lower guide sleeves 20 to slide upward along the guide rods 4. Meanwhile, the downward motion of the seat frame 12 rear end moves the rear support rods 8 downward and folds the chair leg 22 upward on the rod 17 of axis and when the seat cushion 11 is folded flat against the chair back 1, the guide rods 4 are retracted upward along the upper and lower guide sleeves 2 and 20, while the chair leg 22 is also folded down against the rear surface of the chair back 1 such that the entire massage chair becomes completely folded.

In the structure of the invention herein, the motive power structure 19 is installed at the lower extent of the chair back 1 rear surface and, furthermore, extends to the lower surface of the seat cushion 11, with such a design enabling a massage wheel 15 to be maintained at the lower surface of the seat cushion 11 when not utilized.

In summation of the foregoing section, since the disclosed structure and arrangement of folding massage chair structure of the invention herein is fully capable of achieving the claimed objectives and functions and, furthermore, was not observed in publications or in public utilization prior to patent application, the present invention meets the new patent requirements of originality and progressiveness and is, therefore, submitted for review and the granting of the commensurate patent rights.

However, the said detailed description and drawings of the disclosure only concerns one embodiment of the invention herein which shall not be construed as a limitation on the actual claims of the present invention and all modifications based on the structural features and functions in the said descriptions and following claims shall remain within the patented scope and claims of the invention herein.

What is claimed is:

1. A folding massage chair comprising:

a) a chair back having two opposite lateral sides, each opposite lateral side having an upper and a lower guide sleeve mounted thereon;

b) two guide rods, each guide rod slidably passing through the upper and lower guide sleeves on one of the two opposite lateral sides of the chair back, each guide rod having a lower end;

c) a connector plate attached to each guide rod;

d) a chair seat including a seat frame pivotally connected to the connector plates so as to be movable between a use position and a folded position in which the chair seat is pivoted toward the chair back;

e) a chair leg pivotally connected to the lower end of each guide rod; and, f) a rear support rod connected between the seat frame and each chair leg, whereby pivoting movement of the chair seat toward the folded position slides the guide rods with respect to the associated guide sleeves and moves the rear support rods such that the chair legs are pivoted toward the chair back.

2. The folding massage chair of claim 1 further comprising roller wheels mounted to the lower ends of the guide rods.

* * * * *